US008887820B2

(12) United States Patent
Hill et al.

(10) Patent No.: US 8,887,820 B2
(45) Date of Patent: Nov. 18, 2014

(54) INERT GAS SUPPRESSION SYSTEM NOZZLE

(75) Inventors: Gene Hill, Odessa, MO (US); Devang Patel, London (GB)

(73) Assignee: Fike Corporation, Blue Springs, MO (US)

( * ) Notice: Subject to any disclaimer, the term of this patent is extended or adjusted under 35 U.S.C. 154(b) by 169 days.

(21) Appl. No.: 13/106,578

(22) Filed: May 12, 2011

(65) Prior Publication Data

US 2012/0285705 A1 Nov. 15, 2012

(51) Int. Cl.
*A62C 35/00* (2006.01)
*A62C 35/68* (2006.01)

(52) U.S. Cl.
CPC ..... *A62C 35/68* (2013.01)
USPC ..... 169/11; 169/16

(58) Field of Classification Search
CPC ..... A62C 3/00; A62C 3/002; A62C 3/006; A62C 35/02; B05B 7/06
USPC ..... 169/11, 16, 17, 37, 45–47; 239/370, 239/371, 589, 590, 590.5, 558
See application file for complete search history.

(56) References Cited

U.S. PATENT DOCUMENTS

| | | | | |
|---|---|---|---|---|
| 2,310,552 | A * | 2/1943 | Schaaf | 169/11 |
| 4,116,387 | A * | 9/1978 | Kremer et al. | 239/338 |
| 4,185,715 | A | 1/1980 | Reu Boiu | |
| 4,417,868 | A * | 11/1983 | Putnam | 431/1 |
| 5,495,893 | A * | 3/1996 | Roberts et al. | 169/37 |
| 5,794,836 | A | 8/1998 | Lin et al. | |
| 6,106,276 | A | 8/2000 | Sams et al. | |
| 6,942,040 | B1 | 9/2005 | Phuong et al. | |
| 7,472,774 | B1 | 1/2009 | Monson et al. | |
| 7,726,408 | B2 | 6/2010 | Reilly et al. | |
| 2002/0023762 | A1 | 2/2002 | Kotliar | |
| 2005/0115722 | A1 * | 6/2005 | Lund et al. | 169/5 |
| 2009/0031730 | A1 * | 2/2009 | Herrmann | 60/770 |
| 2010/0115964 | A1 | 5/2010 | Kirby | |
| 2010/0181081 | A1 | 7/2010 | Reilly et al. | |

FOREIGN PATENT DOCUMENTS

| | | |
|---|---|---|
| EP | 1151800 | 7/2001 |
| JP | 4049982 | 2/1992 |
| JP | 6166928 | 6/1994 |

OTHER PUBLICATIONS

The International Search Report and Written Opinion dated Sep. 24, 2012.

De Rosa, Maria "Effectiveness of Various Concentrations of an Inert Gas Mixture for Preventing and Suppressing Mining Equipment Cab Fires: Development of a Dual Cab Fire Inerting System," Center for Disease Control and Prevention.

* cited by examiner

*Primary Examiner* — Davis Hwu
(74) *Attorney, Agent, or Firm* — Hovey Williams LLP

(57) ABSTRACT

Nozzles (22) for reducing noise generated by the release of gas from a hazard suppression system (10) are provided. The nozzles (22) comprise a plurality of partitions (42, 44, 46, 48) that define a serpentine gas flow path through the nozzle. The flow path causes the gas to undergo a plurality of expansions and directional changes thereby reducing the velocity of the gas and dampening the generation of sound waves as the gas exits the nozzle (22) through the nozzle outlet (40).

35 Claims, 7 Drawing Sheets

INERT GAS SUPPRESSION SYSTEM NOZZLE

BACKGROUND OF THE INVENTION

1. Field of the Invention

The present invention is generally directed toward acoustic energy dampening nozzles, and hazard-suppression systems employing those nozzles, which reduce the intensity of sound waves generated during passage of a gas therethrough. Particularly, nozzles according to the present invention comprise a series of internal partitions that define a flow path for the gas as it passes through the nozzle. The flow path is configured so as to expand the gas thereby reducing its velocity as it traverses between the nozzle inlet and outlet.

2. Description of the Prior Art

Hazard-suppression systems, especially fire-suppression systems, are widely employed to protect enclosed spaces housing valuable equipment, such as computer servers, from damage due to a fire. Certain hazard-suppression systems useful in this regard involve the introduction of an inert gas, such as nitrogen, argon, or a mixture thereof, into the area being protected. The introduction of an inert gas into the enclosed space reduces the oxygen concentration in the space to a level that is too low to support combustion. However, enough breathable oxygen remains within the enclosed space to allow for the safety of persons within the space at the time the suppression system is activated.

However, preventing damage from fire and heat is not the only concern for hazard-suppression systems designed to protect computer server rooms. The article "Fire Suppression Suppresses WestHost for Days," *Availability Digest*, May 2010, describes the damage that can be done to computer hard disk drives during activation of an inert gas hazard-suppression system. While performing a test of the hazard-suppression system, an actuator fired which accidentally triggered the release of a large blast of inert gas into an area housing hundreds of servers and disk storage systems. During this accidental release, many of these servers and storage systems were severely damaged.

It was later discovered that the primary cause of damage to the hard disks was not the exposure to the fire-suppressing gas agent, but rather noise that accompanied the accidental triggering of the fire-suppression system. See, "Fire Suppressant's Impact on Hard Disks," *Availability Digest*, February 2011. Subsequent testing also showed that loud noises, such as those generated by the activation of the fire-suppression system, can reduce the performance of hard disk drives by up to 50%, resulting in temporary disk malfunction and damage to disk sectors. Thus, the foregoing incident shed light on the problem of noise levels during activation of inert gas fire-suppression systems, and the need for controlling noise in order to adequately protect sensitive computer equipment.

SUMMARY OF THE INVENTION

In one embodiment according to the present invention, there is provided a nozzle for introducing a gas into an area to be protected by an inert gas hazard-suppression system. The nozzle generally comprises a nozzle housing having a gas inlet and a gas outlet and at least a first innermost partition and a second outer partition located within the housing. The first partition defines an inner gas-receiving chamber into which a gas flowing through the gas inlet is received. The first and second partitions cooperate to define a first annular region therebetween. The first annular region being fluidly connected with the inner gas-receiving chamber by a first passage located at the distal end of the first partition. The partitions are configured such that the gas flows in the first annular region in an opposite direction to the gas flowing in the inner gas-receiving chamber. The second partition partially defines a second annular region outboard of the second partition. The second annular region is fluidly connected with the first annular region by a second passage located opposite from the first passage. The second annular region is configured such that the gas flows in the second annular region toward the gas outlet in an opposite direction to the gas flowing in the first annular region.

In another embodiment according to the present invention, there is provided a nozzle for introducing a gas into an area to be protected by an inert gas hazard-suppression system. The nozzle generally comprises a nozzle housing having a gas inlet and a gas outlet, a plurality of generally cylindrical partitions located within the housing, and a nozzle stem operable to conduct a gas into the interior of the nozzle. The plurality of partitions cooperate to define a flow path for the gas as it flows between the gas inlet and the gas outlet and includes an innermost partition defining an inner gas-receiving chamber. The nozzle stem comprises an axial bore formed therein and operable to conduct gas through the gas inlet into the inner gas-receiving chamber. The flow path is configured such that gas flowing therein is forced to alternate between flowing a direction toward and a direction away from the gas outlet.

In yet another embodiment according to the present invention, there is provided an inert gas hazard-suppression system comprising a pressurized source of an inert gas, conduit for directing a flow of the inert gas from the source to an area protected by the system, and a nozzle according to any embodiment described herein coupled with the conduit for introducing the flow of the inert gas into the area protected the system.

In still another embodiment according to the present invention, there is provided a method of reducing the sound waves generated by the discharge of a gas from a hazard-suppression system. The method generally comprises detecting a hazardous condition within an area to be protected by the suppression system, initiating a flow of the gas from a pressurized gas source toward the area to be protected, directing the flow of gas through a nozzle having a gas inlet fluidly connected with a gas outlet by a gas flow path, and discharging the gas from the gas outlet into the area to be protected. The flow path within the nozzle causes the gaseous material to alternate between flowing a direction toward and a direction away from the gas outlet.

DETAILED DESCRIPTION OF THE PREFERRED EMBODIMENT

Figure 1:
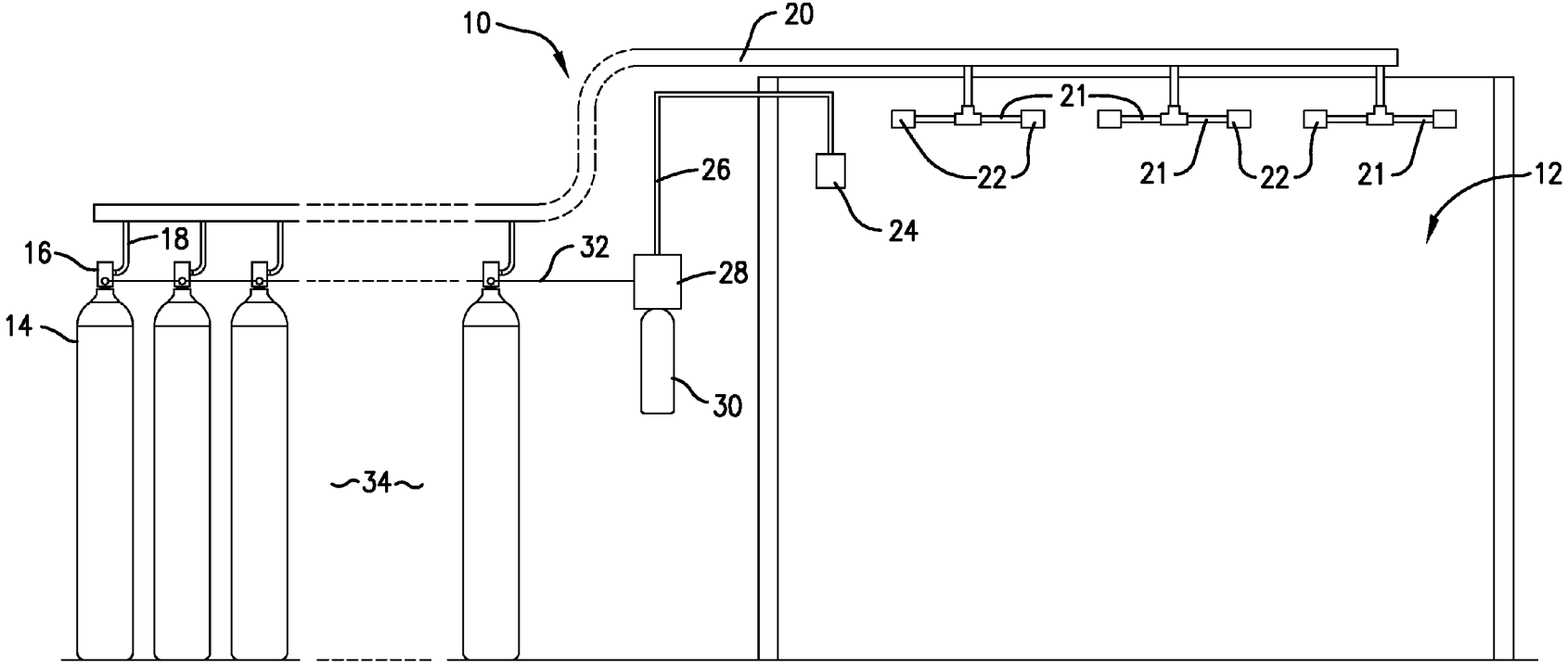
FIG. 1 is a schematic representation of a hazard suppression system, such as an inert gas suppression system.

FIG. 1 illustrates an exemplary hazard suppression system 10 that is designed to protect an enclosed area or room 12, which may house computer equipment or other valuable components. Broadly speaking, the system 10 includes a plurality of high-pressure inert gas cylinders 14 each equipped with a valve unit 16. Exemplary valve units include those taught by U.S. Pat. No. 6,871,802, which is incorporated by reference herein in its entirety, or can be used with other valves when supplied via a manifold having a control orifice. Each valve unit 16 is connected via a conduit 18 to a manifold assembly 20. Distribution piping 21 branches off from assembly 20 and is equipped with a plurality of nozzles 22 for delivery of inert gas into the room 12 for hazard suppression purposes. The piping making up the assembly 20 and distribution piping 21 may be conventional schedule 40 pipe. Alternatively, assembly 20 and piping 21 may be heavy-duty schedule 160 manifold piping and comprise a pressure letdown orifice plate for controlling the flow of gas to nozzles 22. The overall system 10 further includes a hazard detector 24 which is coupled by means of an electrical cable 26 to a solenoid valve 28. The latter is operatively connected to a small cylinder 30 normally containing pressured nitrogen or some other appropriate pilot gas. The outlet of valve 28 is in the form of a pilot line 32 which is serially connected to each of the valve units 16. As depicted in FIG. 1, the plural cylinders 14 may be located within an adjacent room or storage area 34 in proximity to the room 22.

Gas cylinders 14 are conventionally heavy-walled upright metallic cylinders containing therein an inert gas (typically nitrogen, argon, carbon dioxide, and/or mixtures thereof) at relatively high-pressure on the order of 150-300 bar, and particularly on the order of 300 bar. The valve unit 16 may be designed to provide delivery of inert gas from cylinder 14 to manifold assembly 20 at a much reduced pressure than is present within the cylinder over a substantial part of the time that gas flows from the cylinder.

Figures 2, 3:
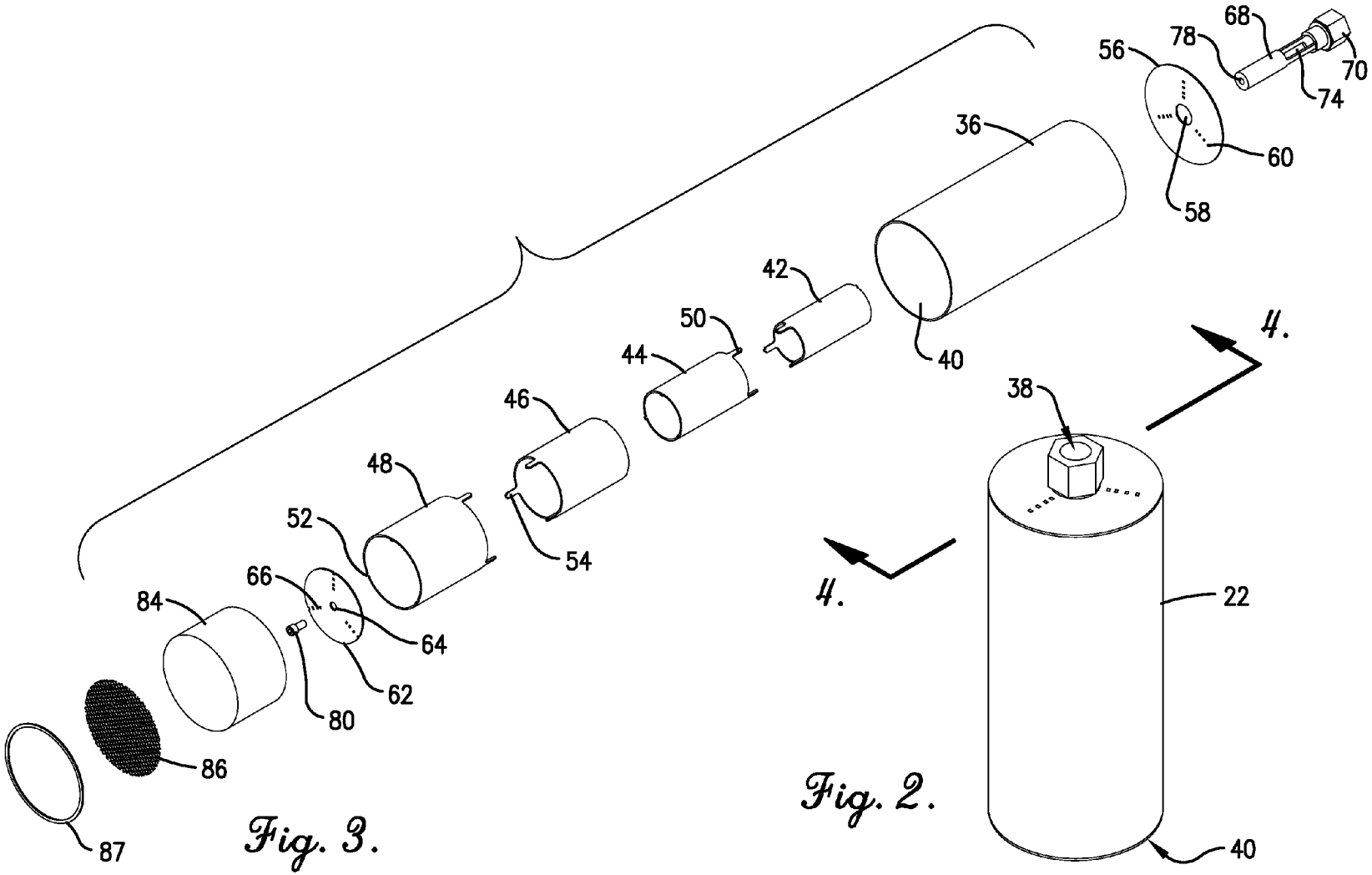
FIG. 2 is a perspective view of a nozzle assembly according to one embodiment of the present invention.
FIG. 3 is an exploded view of the nozzle assembly of FIG. 2.

FIG. 2 illustrates one embodiment of a nozzle 22 according to the present invention. Nozzle 22 comprises a nozzle inlet 38 that is adapted for connection to distribution piping 21 and a nozzle outlet 40 that is configured to disperse, for example, an inert gas into an area to be protected by hazard-suppression system 10. As can be seen in FIG. 3, nozzle 22 comprises a nozzle housing 36 into which a plurality of partitions 42, 44, 46, 48 are secured, the partitions serving to define a gas flow path through nozzle 22. It is noted that the embodiments illustrated in the Figures comprise four partitions, however, it is understood that nozzle 22 can be configured with any desired number or plurality of partitions depending upon the particular application.

Partitions 42, 44, 46, 48 are configured so as to be substantially concentric and nest within each other. However, as explained below with reference to FIGS. 8 and 9, it is within the scope of the present invention for the partitions to be installed within housing 36 in a non-concentric manner. Particularly, partition 42 comprises an innermost partition having the smallest diameter of the various partitions. Accordingly, each successive partition has a diameter that is larger than the immediately preceding partition. Partition 42 is received within partition 44, which is received within partition 46, which is received within partition 48. Each of partitions 44, 46, and 48 substantially circumscribes its respective adjacent inner partition. In the embodiment illustrated in FIGS. 2-4, each partition comprises a plurality of legs 50 projecting from one end of the partition and, optionally, a plurality of smaller protuberances 52 projecting from the opposite end of the partition. As explained in greater detail below, legs 50 assist with defining passages through partitions which assist in defining the flow path for the nozzle; however, it is within the scope of the present invention for other structures to define these passages in place of legs 50, such as a plurality of orifices disposed adjacent an end margin of the partition. As illustrated, legs 50 optionally comprise small protuberances 54, similar in size and configuration to protuberances 52, at the distal ends thereof. As also explained below, protuberances 52, 54 can facilitate proper alignment of partitions 42, 44, 46, 48 within housing 36.

Figure 4:
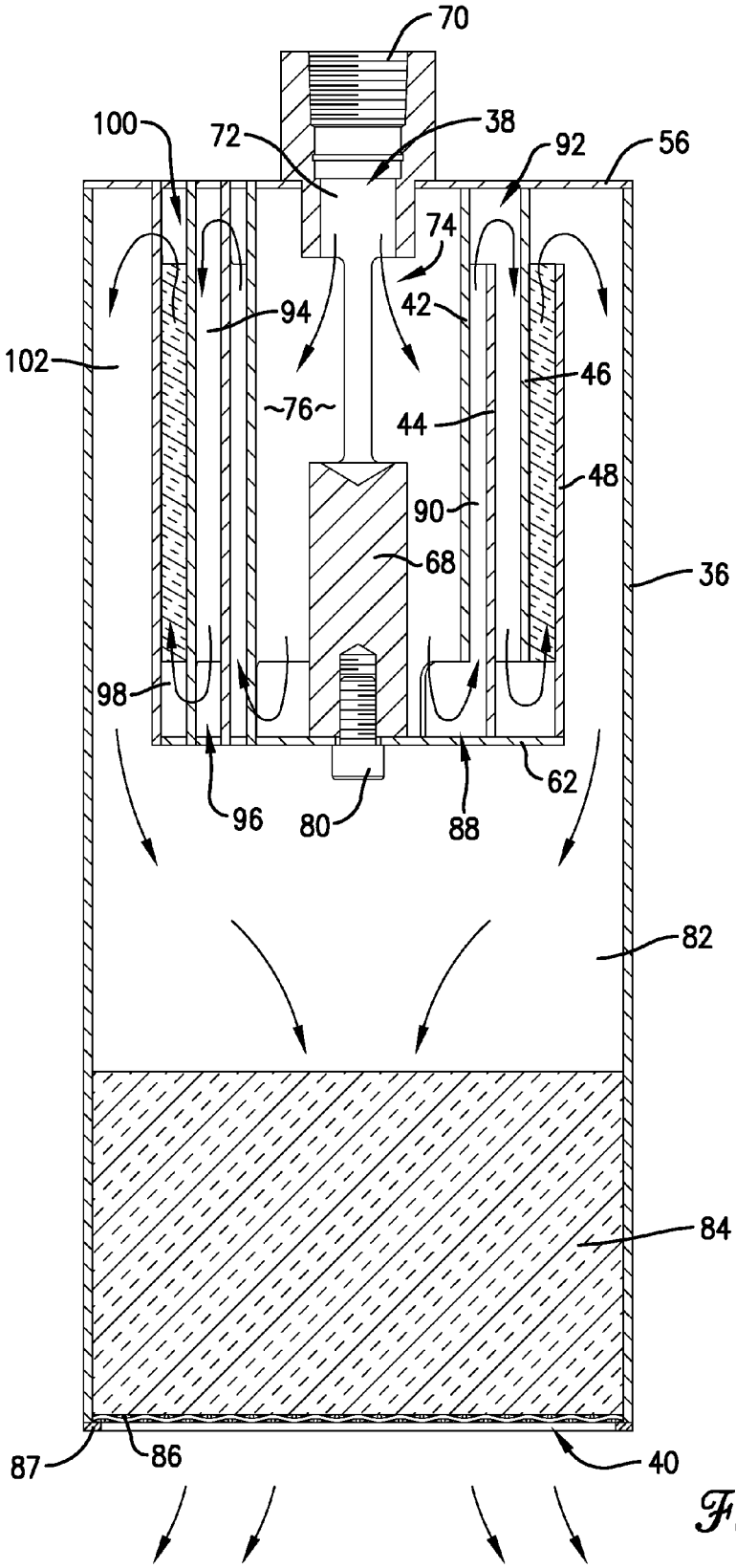
FIG. 4 is a cross-sectional view of the nozzle assembly of FIG. 2 also showing the gas flow path through the nozzle.

Nozzle 22 further comprises an inlet end plate 56 having a central orifice 58 and a plurality of radially-spaced apertures 60. Nozzle 22 also comprises an internal end plate 62 that is configured very similarly to end plate 56, except that end plate 62 is of smaller diameter than end plate 56. End plate 62 includes a central orifice 64 and a plurality of radially-spaced apertures 66. Apertures 60, 66 are sized to receive protuberances 52, 54 of the respective partitions thereby assisting with assembly of the partitions within the nozzle and ensuring proper alignment thereof. It will be appreciated that for the alternate embodiment discussed above, if the partitions are equipped with orifices instead of aperture-defining legs, inlet end plate 56 and internal end plate 62 may comprise slots or grooves instead of apertures 60, 66 for receiving and properly aligning the partitions within housing 36. As can be seen in FIGS. 3 and 4, the legs 50 (or apertures in the alternate embodiment) of respective adjacent partitions are oriented in an alternating manner such that the legs of one partition extend in a direction opposite from the legs of the partition(s) adjacent thereto. Once protuberances 52, 54 are inserted into apertures 60, 66 they may be secured in place through the use of an epoxy or other similar adhesive material, or by welding (spot or seam).

A nozzle stem 68 is inserted through central orifice 58 so as to direct the flow of gas from system 10 into the interior of nozzle 22. Stem 68 comprises a threaded, pipe-receiving fitting 70 at one end thereof that is operable to attach nozzle 22 to distribution piping 21. As can best be seen in FIG. 4, stem 68 comprises an axial bore 72 which permits passage of gas through stem 68 and into nozzle 22 through nozzle inlet 38. Stem 68 further comprises a plurality of ports 74 permitting fluid communication of bore 72 with an inner gas-receiving chamber 76 defined by inner partition 42. Stem 68 also includes a threaded, fastener-receiving bore 78 formed in the end opposite from fitting 70. As shown in the Figures, bore 78 is configured to receiving a bolt 80 which secures the partition-end plate assembly to stem 68.

Nozzle 22 includes an outlet chamber 82 located between end plate 62 and outlet 40. Chamber 82 may contain a packing material 84, which comprises a permeable sound absorbent material, such as stainless steel wool, which operates to further dampen the sound generated by the flow of gas through nozzle 22. The packing material 84 is maintained within nozzle 22 by a screen 86 and end ring 87 which is secured to the outlet end of housing 36. As illustrated in FIG. 4, packing material 84 optionally may be inserted into one or more of the annular spaces between the partitions if desired.

Partitions 42, 44, 46, 48 cooperate to define a flow path through nozzle 22 for gas supplied thereto by distribution piping 21. The flow path is represented in FIG. 4 by a series of arrows. As discussed above with respect to hazard-suppression systems, a flow of gas can be initiated by detection of a hazardous condition within an area to be protected by the suppression system. An actuation mechanism causes gas from a pressurized gas source to flow within a piping system toward one or more nozzles installed within the area to be protected. In certain systems, the gas arrives at the nozzle flowing at approximately 1500 cfm at a pressure of 600 psi. Gas initially enters nozzle 22 through nozzle inlet 38 and through bore 72 in nozzle stem 68. The gas exits nozzle stem 68 through ports 74 and enters inner chamber 76. Upon entering inner chamber 76, the gas undergoes a first expansion which slows the velocity of the gas. The gas continues to flow in chamber 76 in a direction toward internal end plate 62, which also happens to be in a direction toward nozzle outlet 40. The gas is then directed through a plurality of first passages 88 formed in and located at the distal end of inner partition 42 and enters a first annular region 90 defined by partitions 42 and 44. Upon entry into annular region 90, the gas is caused to flow in a direction opposite to the gas flowing in the inner gas-receiving chamber (i.e., substantially a 180° change in direction). Gas in annular region 90 flows in the direction toward upper end plate 56, through which nozzle inlet 38 is formed.

The gas is then directed through a plurality of second passages 92 formed in partition 44, opposite from passages 88, and enters a second annular region 94 defined by partitions 44 and 46. Upon entry into annular region 94, the gas is caused to change its direction of flow once again so as to flow in a direction opposite to the gas flowing in first annular region 90. The gas once again flows in a direction toward internal end plate 62 (i.e., in the direction of nozzle outlet 40). Upon entering into second annular region 94, the gas undergoes another expansion thereby further decreasing its velocity.

The gas continues its serpentine-like flow through nozzle 22 by passing through one of a plurality of third passages 96 formed in partition 46 and enters a third annular region 98 defined by partitions 46 and 48. Upon entry into annular region 98, the gas expands yet again and changes its direction of flow so as to flow toward upper end plate 56.

The gas flows upward in third annular region 98 until it reaches a plurality of fourth passages 100 formed in partition 48. The gas is then directed through passages 100 into a fourth annular region 102 defined by partition 48 and housing 36. Upon entry into annular region 102, the gas expands again and changes its direction of flow so as to flow in a direction toward nozzle outlet 40. The gas continues to flow out of annular region 102 into outlet chamber 82, then through nozzle outlet 40.

The plurality of expansions and 180° directional changes reduce the velocity of the gas flowing through nozzle 22 so that the velocity of the gas exiting through outlet 40 is less than the velocity of the gas had it not been directed through the flow path defined by the various partitions. This results in an effective dampening of acoustical energy generated by the gas stream exiting nozzle 22.

Figures 5, 6:
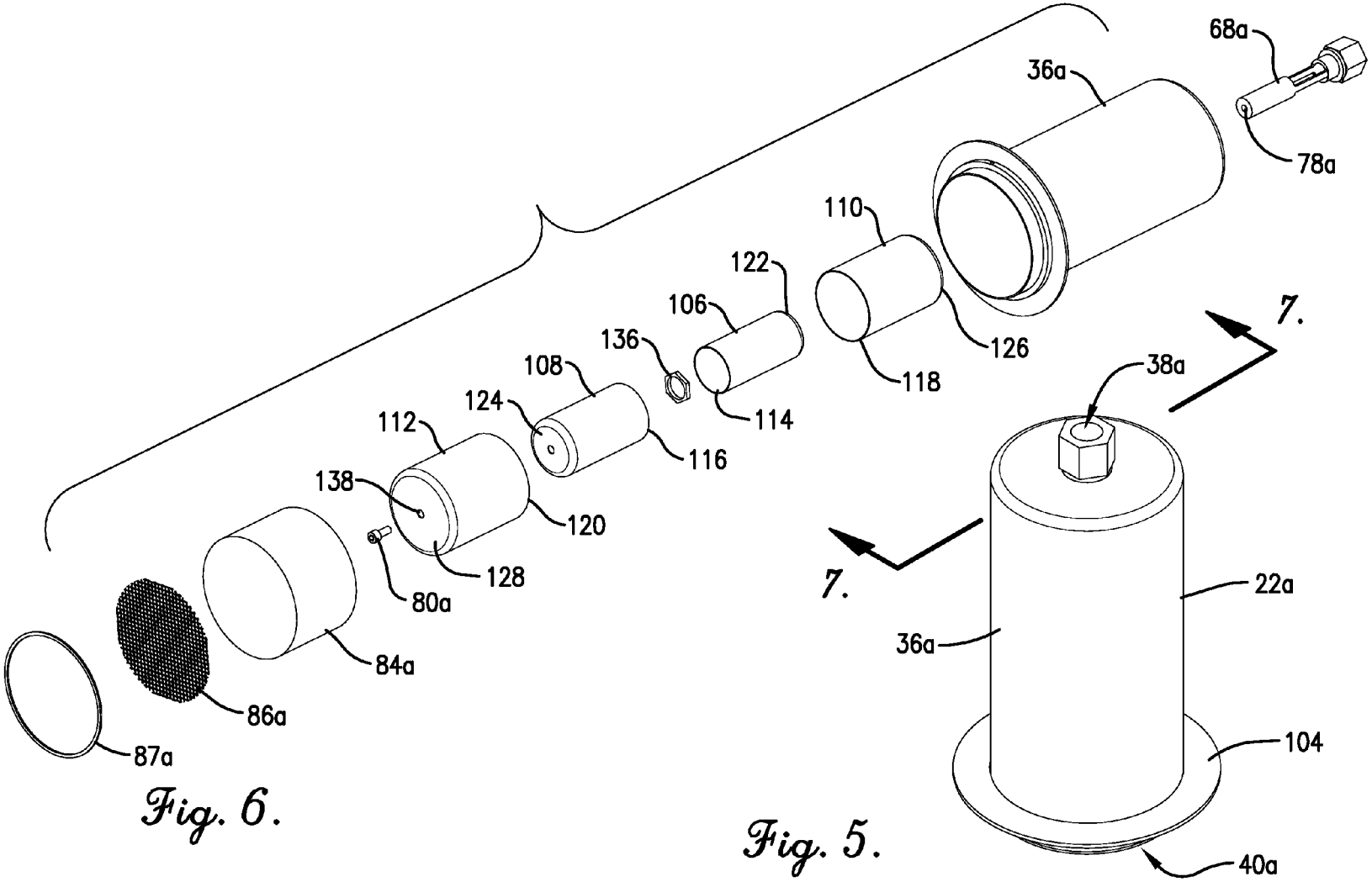
FIG. 5 is a perspective view of a nozzle assembly according to another embodiment of the present invention.
FIG. 6 is an exploded view of the nozzle assembly of FIG. 5.
Figure 7:
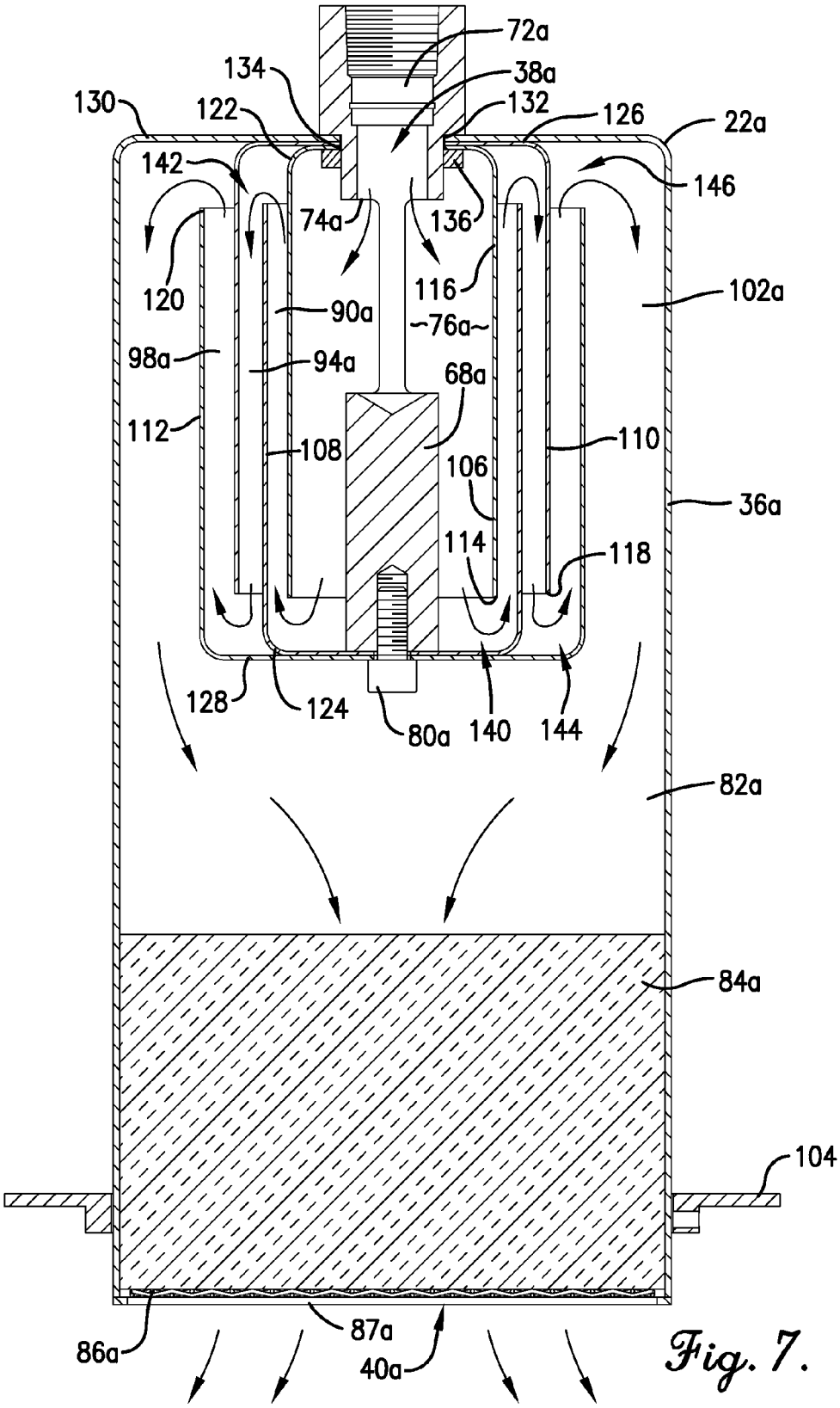
FIG. 7 is a cross-sectional view of the nozzle assembly of FIG. 5 showing the gas flow path through the nozzle.

FIGS. 5-7 illustrate another embodiment according to the present invention. This embodiment is similar to the first embodiment discussed above, however, cylindrical partitions 42, 44, 46, and 48 are replaced with a plurality of cup-shaped elements nested within each other. Turning first to FIG. 5, a nozzle 22*a* is shown along with an optional ceiling ring 104 attached to housing 36*a* proximate nozzle outlet 40*a*. Ceiling ring 104 is provided to improve the aesthetics of nozzle 22*a* installed through a ceiling within an area to be protected. Much like nozzle 22 discussed above, nozzle 22*a* also includes a nozzle inlet 38*a* that is adapted for connection to manifold assembly 20.

As can be seen in FIGS. 6 and 7, nozzle 22*a* comprises a plurality of cup-shaped elements 106, 108, 110, 112. Each cup-shaped element comprises a respective open end 114, 116, 118, 120 and a respective closed end 122, 124, 126, 128. The cup-shaped elements are secured within a cup-shaped nozzle housing 36*a* which comprises a closed end 130 having a central orifice 132 formed therein sized to receive a nozzle stem 68*a*. Cup-shaped elements 106, 110 are oriented within housing 36*a* such that their open ends 114, 118, respectively, are positioned toward nozzle outlet 40*a*, whereas cup-shaped elements 108, 112 are oriented with their open ends 116, 120 facing housing closed end 130.

Each cup-shaped element closed end comprises a central orifice therethrough. The central orifice 132 for cup-shaped elements 106, 110 is substantially the same diameter as orifice 132 formed in housing closed end 130 and is thus capable of receiving nozzle stem 68*a* therethrough. Cup-shaped elements 106, 110 are secured to nozzle stem 68*a* by a threaded connector such as nut 136. Cup-shaped elements 108, 112 also comprise a central orifice 138 formed in their respective closed ends 124, 128. Orifice 138 is generally smaller in diameter than orifice 134 and is sized to receive a bolt 80*a* that is threadably received within bore 78*a* of nozzle stem 68*a*.

As shown in FIG. 7, cup-shaped elements 106, 108, 110, 112 are configured such that their respective ends 114, 116, 118, 120 do not extend all of the way to the closed end of the nearest adjacent element(s). Thus, passages 140, 142, 144, 146 are provided that help define a gas flow path through nozzle 22*a*. As with nozzle 22, a packing material 84*a* comprising a sound absorbent material, such as stainless steel wool, is provided in outlet chamber 82*a* and his held in place by a screen 86*a* and end ring 87*a*. Packing material 84*a* may also be inserted into the annular spaces between the partitions if desired.

The flow path of gas through nozzle 22*a* is represented in FIG. 7 by a series of arrows. Gas initially enters nozzle 22*a* through nozzle inlet 38*a* and through bore 72*a* in nozzle stem 68*a*. The gas exits nozzle stem 68*a* through ports 74*a* and enters a inner chamber 76*a* defined by cup-shaped element 106. Upon entering inner chamber 76*a*, the gas undergoes a first expansion thereby reducing the velocity of the gas. The gas continues to flow in chamber 76*a* in a direction that is toward nozzle outlet 40. The gas is then directed through passage 140 and enters a first annular region 90*a* defined by the cylindrical portions of cup-shaped elements 106, 108. Upon entry into annular region 90*a*, the gas is caused to flow in a direction opposite to the gas flowing in the inner gas-receiving chamber 76*a*. Particularly, gas in annular region 90*a* flows in the direction toward the closed end 130 of housing 36*a*.

Upon reaching the end of annular region 90 proximate closed end 126 of cup-shaped element 110, the gas is then directed through a second passage 142 and enters a second annular region 94*a* defined by cup-shaped elements 108, 110. Upon entry into annular region 94*a*, the gas is caused to change its direction of flow once again so as to flow in a direction opposite to the gas flowing in first annular region 90*a*. Particularly, the gas once again flows in a direction toward nozzle outlet 40*a*, and more particularly, toward closed end 128 of cup-shaped element 112. Upon entering into second annular region 94*a*, the gas undergoes another expansion thereby further decreasing its velocity.

The gas continues flowing through nozzle 22*a* by passing through a third passage 144 and enters a third annular region 98*a* defined by the cylindrical portions of cup-shaped elements 110, 112. Upon entry into annular region 98*a*, the gas expands yet again and changes its direction of flow so as to flow toward housing closed end 130.

The gas flows upwardly in third annular region 98*a* until it reaches a fourth passage 146. The gas is then directed through passage 146 into a fourth annular region 102*a* defined by cup-shaped element 112 and housing 36*a*. Upon entry into annular region 102*a*, the gas expands again and changes its direction of flow so as to flow in a direction toward nozzle outlet 40*a*. The gas continues to flow out of annular region 102*a* into outlet chamber 82*a*, then through nozzle outlet 40*a*.

Figure 8:
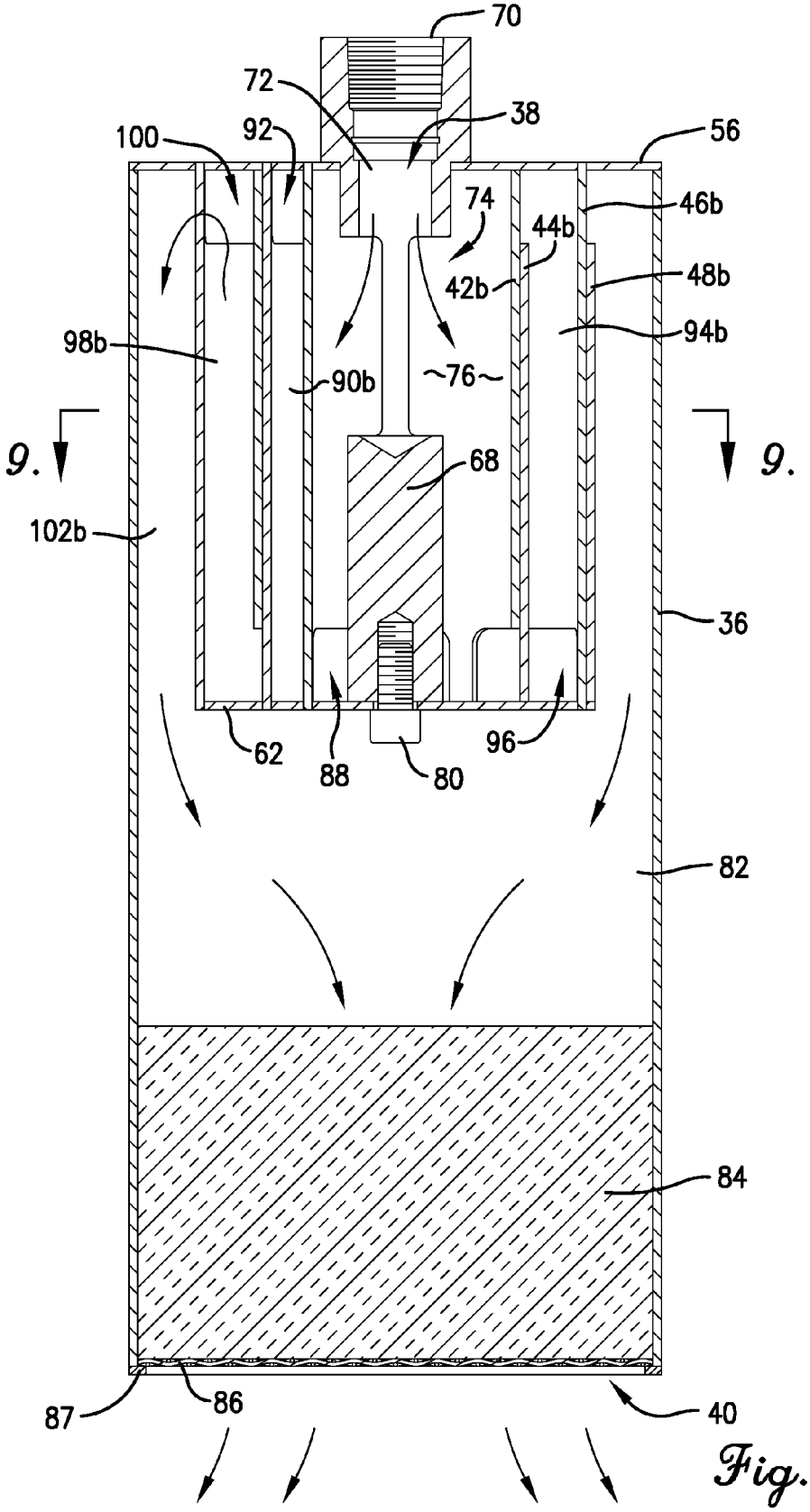
FIG. 8 is a cross-sectional view of an alternate nozzle embodiment according to the present invention.
Figure 9:
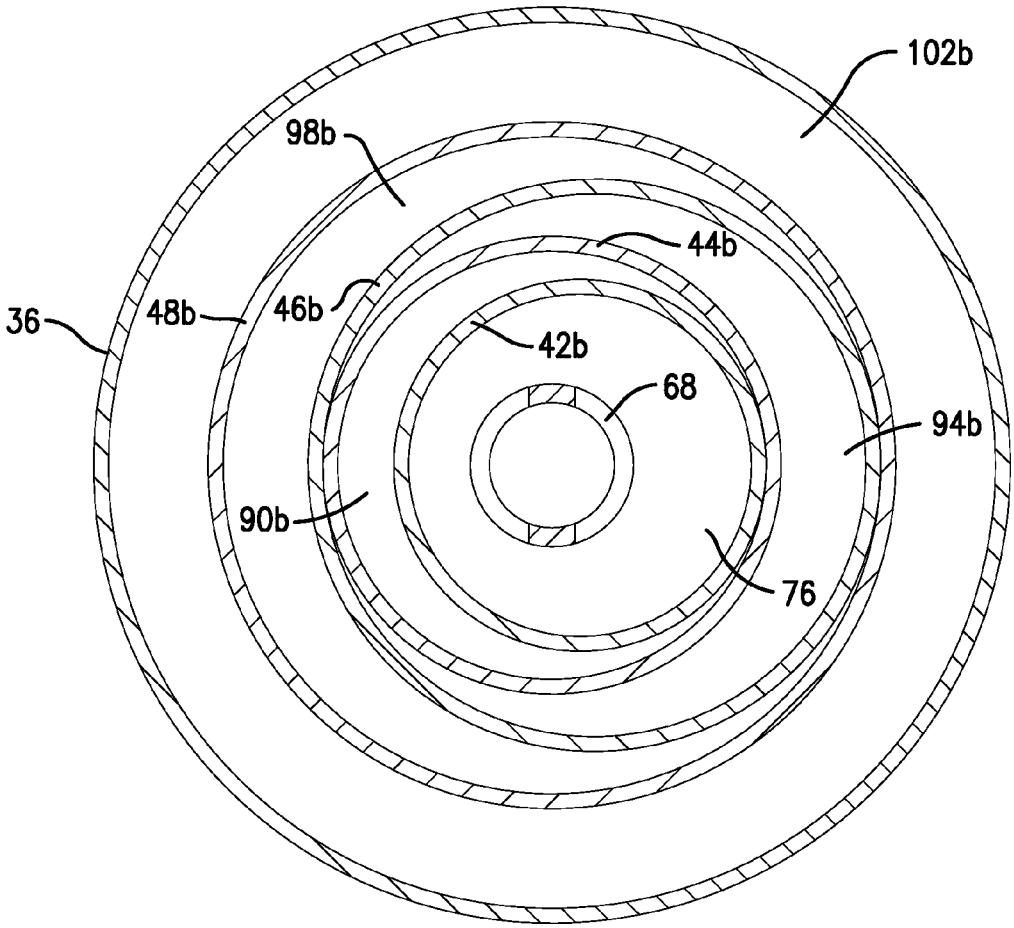
FIG. 9 is a view of the nozzle of FIG. 8 taken along line 9-9.

FIGS. 8 and 9 illustrate an alternate nozzle embodiment in accordance with the present invention. Nozzle 22*b* is constructed very similarly to nozzle 22 of FIGS. 2-4, except that the internal partitions are arranged in a non-concentric manner. Partitions 42*b*, 44*b*, 46*b*, and 48*b* are arranged non-concentrically about nozzle stem 68, thereby forming a plurality of asymmetrical or crescent-shaped annular regions 90*b*, 94*b*, and 98*b*. Gas flows through central chamber 68 and the annular regions in similar fashion to the embodiments discussed previously.

We claim:

1. A nozzle for introducing a gas into an area to be protected by an inert gas hazard-suppression system comprising:

a nozzle housing having a gas inlet and a gas outlet;

a nozzle stem having an axial bore formed therein; and at least a first innermost partition and a second outer partition located within said housing, said first partition defining an inner gas-receiving chamber into which said nozzle stem extends and into which a gas flowing through said gas inlet and said axial bore is received, said first and second partitions cooperating to define a first annular region therebetween, said first annular region being fluidly connected with said inner gas-receiving chamber by a first passage located at the distal end of said first partition opposite said gas inlet, said partitions being configured such that gas flowing from said chamber into said first annular region undergoes a 180° change in direction as it flows through said first passage resulting in the gas flowing in said first annular region in an opposite direction to the gas flowing in said inner gas-receiving chamber, said second partition partially defining a second annular region outboard of said second partition, said second annular region being fluidly connected with said first annular region by a second passage located opposite from said first passage, said second annular region being configured such that the gas flows in said second annular region toward said gas outlet in an opposite direction to the gas flowing in said first annular region, said nozzle stem comprising a fastening element operable to secure at least one of said partitions within said housing.

2. The nozzle according to claim 1, wherein said nozzle stem comprises one or more ports for permitting flow of the gas from said bore into said inner gas-receiving chamber.

3. The nozzle according to claim 1, wherein said first and second partitions are substantially cylindrical and are attached to a circular end plate.

4. The nozzle according to claim 3, wherein said circular end plate is secured to said nozzle stem by said fastening element.

5. The nozzle according to claim 1, wherein said first and second partitions comprise first and second cup-shaped elements, respectively, said first cup-shaped element having an open end located opposite from said gas inlet, said second cup-shaped element having an open end located adjacent to said gas inlet.

6. The nozzle according to claim 1, said nozzle further comprising third and fourth partitions outboard of said first and second partitions, said second and third partitions cooperatively defining said second annular region, said third and fourth partitions cooperatively defining a third annular region, said fourth partition and said nozzle housing cooperatively defining a fourth annular region.

7. The nozzle according to claim 6, wherein said second annular region and said third annular region are fluidly connected by a third passage located opposite from said second passage, and said third annular region and said fourth annular region are fluidly connected by a fourth passage located opposite from said third passage.

8. The nozzle according to claim 7, wherein said third annular region is configured such that the gas flows in said third annular region in an opposite direction to the gas flowing in said second annular region, and said fourth annular region is configured such that the gas flows in said fourth annular region in an opposite direction to the gas flowing in said third annular region.

9. The nozzle according to claim 1, wherein said nozzle further comprises a sound-absorbing packing material located within said housing upstream from said outlet and downstream from said partitions.

10. The nozzle according to claim 9, wherein said packing material comprises stainless steel wool.

11. The nozzle according to claim 9, wherein said packing material is maintained within said housing by a screen.

12. The nozzle according to claim 1, wherein said first and second partitions are substantially concentric.

13. A nozzle for introducing a gas into an area to be protected by an inert gas hazard-suppression system comprising:

a nozzle housing having a gas inlet and a gas outlet;

a plurality of generally cylindrical partitions located within said housing, said partitions cooperating to define a flow path for the gas as it flows between said gas inlet and said gas outlet, said plurality of partitions including an innermost partition defining an inner gas-receiving chamber, said innermost partition including a first passage located at the distal end of said innermost partition opposite said gas inlet; and a nozzle stem having an axial bore formed therein, said nozzle stem extending into said inner gas-receiving chamber and operable to conduct gas through said gas inlet into said inner gas-receiving chamber, said nozzle stem comprising a fastening element operable to secure at least one of said partitions within said housing, said flow path being configured such that gas flowing therein is forced to alternate between flowing a direction toward and a direction away from said gas outlet and that gas flowing between said gas inlet and said gas outlet makes at least two 180° changes in direction, wherein the gas flowing between said gas inlet and gas outlet undergoes a first 180° change in direction as it flows through said first passage.

14. The nozzle according to claim 13, wherein said nozzle stem comprises one or more ports for permitting flow of the gas from said bore into said inner gas-receiving chamber.

15. The nozzle according to claim 13, wherein said plurality of partitions are attached to a circular end plate, which is secured to said nozzle stem by said fastening element.

16. The nozzle according to claim 13, wherein said plurality of partitions comprise a plurality of cup-shaped elements having an open end and an opposed closed end, said cup-shaped elements being oriented such that the open end of one cup-shaped element is located adjacent the closed end of at least one other cup-shaped element.

17. The nozzle according to claim 13 wherein said nozzle further comprises a sound-absorbing packing material disposed therein.

18. The nozzle according to claim 17, wherein said packing material is located within said housing upstream from said outlet and downstream from said partitions.

19. The nozzle according to claim 17, wherein said packing material is located within said flow path.

20. The nozzle according to claim 17, wherein said packing material comprises stainless steel wool.

21. The nozzle according to claim 17, wherein said packing material is maintained within said housing by a screen.

22. The nozzle according to claim 13, wherein said plurality of partitions are substantially concentric.

23. An inert gas hazard-suppression system comprising:

a pressurized source of an inert gas;

conduit for directing a flow of said inert gas from said source to an area protected by said system; and a nozzle according to claim 1 coupled with said conduit for introducing the flow of said inert gas into the area protected the system.

24. An inert gas hazard-suppression system comprising:

a pressurized source of an inert gas;

conduit for directing a flow of said inert gas from said source to an area protected by said system; and a nozzle according to claim 13 coupled with said conduit for introducing the flow of said inert gas into the area protected the system.

25. A method of reducing the acoustic energy generated by the discharge of an inert gas from a fire-suppression system comprising:

detecting a hazardous condition indicative of a fire or heat-related event within an area to be protected by said suppression system;

initiating a flow of said gas from a pressurized gas source toward said area to be protected;

directing said flow of gas through a nozzle installed within said protected area having a gas inlet fluidly connected with a gas outlet by a gas flow path, said flow path causing said gaseous material to alternate between flowing a direction toward and a direction away from said gas outlet, and wherein said flow path causes said gas to undergo at least two 180° changes in direction during passage of said gas through said nozzle; and discharging said gas from said gas outlet into said area to be protected.

26. The method according to claim 25, said method further comprising causing said gas to undergo an expansion during at least one of said changes in flow direction along said flow path.

27. The method according to claim 25, wherein said nozzle comprises a plurality of partitions secured within a nozzle housing, said partitions at least partially defining said flow path.

28. The method according to claim 27, wherein said plurality partitions are concentric.

29. A nozzle for introducing a gas into an area to be protected by an inert gas hazard-suppression system comprising:

a nozzle housing having a gas inlet and a gas outlet;

a plurality of generally cylindrical partitions located within said housing, said partitions cooperating to define a flow path for the gas as it flows between said gas inlet and said gas outlet, said plurality of partitions including an innermost partition defining an inner gas-receiving chamber; and a nozzle stem having an axial bore formed therein and operable to conduct gas through said gas inlet into said inner gas-receiving chamber, wherein said nozzle stem comprises a fastening element operable to secure at least one of said partitions within said housing, wherein said plurality of partitions are attached to a circular end plate, which is secured to said nozzle stem by said fastening element, said flow path being configured such that gas flowing therein is forced to alternate between flowing a direction toward and a direction away from said gas outlet.

30. A nozzle for introducing a gas into an area to be protected by an inert gas hazard-suppression system comprising:

a nozzle housing having a gas inlet and a gas outlet;

a plurality of generally cylindrical partitions located within said housing, said partitions cooperating to define a flow path for the gas as it flows between said gas inlet and said gas outlet, said plurality of partitions including an innermost partition defining an inner gas-receiving chamber, wherein said plurality of partitions comprise a plurality of cup-shaped elements having an open end and an opposed closed end, said cup-shaped elements being oriented such that the open end of one cup-shaped element is located adjacent the closed end of at least one other cup-shaped element, said open end of said innermost partition defining a first passage between said innermost partition and one other of said cup-shaped elements; and a nozzle stem having an axial bore formed therein, said nozzle stem extending into said inner gas-receiving chamber and operable to conduct gas through said gas inlet into said inner gas-receiving chamber, said nozzle stem comprising a fastening element operable to secure at least one of said partitions within said housing, said flow path being configured such that gas flowing therein is forced to alternate between flowing a direction toward and a direction away from said gas outlet, wherein the gas flowing between said gas inlet and gas outlet undergoes a 180° change in direction as it flows through said first passage.

31. A nozzle for introducing a gas into an area to be protected by an inert gas hazard-suppression system comprising:

a nozzle housing having a gas inlet and a gas outlet;

a plurality of generally cylindrical partitions located within said housing, said plurality of partitions including an outermost partition within which the others of said plurality of partitions are nested, said plurality of partitions having progressively increasing diameters as said outermost partition is approached, said partitions cooperating to define a flow path for the gas as it flows between said gas inlet and said gas outlet, said plurality of partitions including an innermost partition defining an inner gas-receiving chamber, said innermost partition including a first passage located at the distal end of said innermost partition opposite said gas inlet; and a nozzle stem having an axial bore formed therein, said nozzle stem extending into said inner gas-receiving chamber and operable to conduct gas through said gas inlet into said inner gas-receiving chamber, said nozzle stem comprising a fastening element operable to secure at least one of said partitions within said housing, said flow path being configured such that gas flowing therein is forced to alternate between flowing a direction toward and a direction away from said gas outlet and that gas flowing between said gas inlet and said gas outlet undergoes a 180° change in direction as it flows through said first passage.

32. A nozzle for introducing a gas into an area to be protected by an inert gas hazard-suppression system comprising:

a nozzle housing having a gas inlet and a gas outlet; and at least a first innermost partition and a second outer partition located within said housing, said first partition defining an inner gas-receiving chamber into which a gas flowing through said gas inlet is received, said first and second partitions cooperating to define a first annular region therebetween, said first annular region being fluidly connected with said inner gas-receiving chamber by a first passage located at the distal end of said first partition, said partitions being configured such that the gas flows in said first annular region in an opposite direction to the gas flowing in said inner gas-receiving chamber, said second partition partially defining a second annular region outboard of said second partition, said second annular region being fluidly connected with said first annular region by a second passage located opposite from said first passage, said second annular region being configured such that the gas flows in said second annular region toward said gas outlet in an opposite direction to the gas flowing in said first annular region, said nozzle further comprising third and fourth partitions outboard of said first and second partitions, said second and third partitions cooperatively defining said second annular region, said third and fourth partitions cooperatively defining a third annular region, said fourth partition and said nozzle housing cooperatively defining a fourth annular region.

33. A nozzle for introducing a gas into an area to be protected by an inert gas hazard-suppression system comprising:

a nozzle housing having a gas inlet and a gas outlet;

a nozzle stem having an axial bore formed therein; and at least a first innermost partition and a second outer partition located within said housing, said first partition defining an inner gas-receiving chamber into which said nozzle stem extends and into which a gas flowing through said gas inlet and said axial bore is subsequently received, wherein said first and second partitions are substantially cylindrical and are attached to a circular end plate, said first and second partitions cooperating to define a first annular region therebetween, said first annular region being fluidly connected with said inner gas-receiving chamber by a first passage located at the distal end of said first partition opposite said gas inlet, said partitions being configured such that the gas flows in said first annular region in an opposite direction to the gas flowing in said inner gas-receiving chamber, said second partition partially defining a second annular region outboard of said second partition, said second annular region being fluidly connected with said first annular region by a second passage located opposite from said first passage, said second annular region being configured such that the gas flows in said second annular region toward said gas outlet in an opposite direction to the gas flowing in said first annular region, said nozzle stem comprising a fastening element operable to secure at least one of said partitions within said housing.

34. The nozzle according to claim 33, wherein said circular end plate is secured to said nozzle stem by said fastening element.

35. The nozzle according to claim 1, wherein said nozzle stem is configured such that a gas flowing into said nozzle through said inlet is directed through said axial bore and subsequently into said chamber.

* * * * *